US009828797B2

(12) United States Patent
Curcija

(10) Patent No.: US 9,828,797 B2
(45) Date of Patent: Nov. 28, 2017

(54) INSULATED WINDOW FRAME SYSTEM

(71) Applicant: The Regents of the University of California, Oakland, CA (US)

(72) Inventor: Dragan Charlie Curcija, Richmond, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 14/877,821

(22) Filed: Oct. 7, 2015

(65) Prior Publication Data

US 2016/0097235 A1 Apr. 7, 2016

Related U.S. Application Data

(60) Provisional application No. 62/061,086, filed on Oct. 7, 2014.

(51) Int. Cl.
*E04C 2/38* (2006.01)
*E06B 3/263* (2006.01)
*E06B 3/964* (2006.01)

(52) U.S. Cl.
CPC ..... *E06B 3/263* (2013.01); *E06B 3/9641* (2013.01)

(58) Field of Classification Search
CPC ..... E06B 3/24; E06B 1/36; E06B 3/08; E06B 3/5454; E06B 3/64; E06B 3/22; E06B 3/42; E06B 3/221; E06B 3/04; E06B 3/00; E06B 7/2312; E06B 3/2675; E06B 3/263; E06B 3/9641; E06B 3/26305; E06B 2003/26352; E06B 2003/26356; E06B 2003/26389; E06B 2003/6244; E06B 2003/26378; E06B 2003/26309; E06B 2003/26314; E06B 2003/26332
See application file for complete search history.

(56) References Cited

U.S. PATENT DOCUMENTS 4,057,936 A * 11/1977 Wyatt, Jr. ..... E06B 3/00 454/224
4,815,245 A * 3/1989 Gartner ..... E06B 3/26343 49/DIG. 1
4,889,040 A * 12/1989 Man ..... E06B 7/086 454/224
5,522,196 A * 6/1996 Conroy ..... E06B 3/22 49/DIG. 1
6,966,158 B1 * 11/2005 Christensen ..... E06B 3/22 49/504
D664,679 S * 7/2012 Kim ..... D25/124
2002/0046539 A1 * 4/2002 Schulz ..... E06B 3/2632 52/843
2004/0211134 A1 * 10/2004 Glover ..... E06B 3/24 52/204.5

(Continued)

OTHER PUBLICATIONS

Arasteh, D.; Mitchell, R.; Kohler, C.; Huizenga, C.; and Curcija, D. "Improving Information Technology to Maximize Fenestration Energy Efficiency." Performance of Exterior Envelopes of Whole Buildings VIII: Integration of Building Envelopes Proceedings. Jun. 2001.

(Continued)

*Primary Examiner* — Brian Mattei

(57) ABSTRACT

The present invention provides for a window frame comprising a rigid framework cross-section comprising a truss structure.

10 Claims, 4 Drawing Sheets

(56) References Cited

U.S. PATENT DOCUMENTS

| | | | | |
|---|---|---|---|---|
| 2004/0226232 | A1* | 11/2004 | Engebretson | E06B 1/345 52/204.1 |
| 2005/0183351 | A1* | 8/2005 | Brunnhofer | E06B 3/26305 52/204.5 |
| 2006/0096193 | A1* | 5/2006 | Ohrstrom | B29C 47/0028 52/204.5 |
| 2006/0101734 | A1* | 5/2006 | Fischer | E06B 3/24 52/202 |
| 2010/0018140 | A1* | 1/2010 | Brunnhofer | E06B 3/26303 52/204.71 |
| 2011/0120034 | A1* | 5/2011 | Melkonian | B29C 44/324 52/204.5 |
| 2016/0108658 | A1* | 4/2016 | Cruysberghs | E06B 1/342 52/209 |

OTHER PUBLICATIONS

Bhandari, M.; and Curcija, D. "Investigation of the Effects of Fenestration Systems on the Energy Performance of a Typical Commercial Building." SimBuild 2006 Conference. MIT, Cambridge. Jul. 2006.

Curcija, D.; Arasteh, D.; Huizenga, C.; Kohler, C.; Mitchell, R.; and Bhandari, M. "Analyzing Thermal Performance of Building Envelope Components Using 2-D Heat Transfer Tool with Detailed Radiation Modeling." Seventh International IBPSA Conference. Aug. 2001.

Curcija, D.; Bhandari, M.; Manteghi, M.; and Shah, B. "Component Modeling Methodology for Predicting Thermal Performance or Non-Residential Fenestration Systems". Thermal Performance of Building Envelopes IX, Clearwater, FL. Dec. 2004.

* cited by examiner

INSULATED WINDOW FRAME SYSTEM

RELATED PATENT APPLICATIONS

The application claims priority to U.S. Provisional Patent Application Ser. No. 62/061,086, filed Oct. 7, 2014; which is incorporated herein by reference.

STATEMENT OF GOVERNMENTAL SUPPORT

The invention was made with government support under Contract No. DE-AC02-05CH11231 awarded by the U.S. Department of Energy. The government has certain rights in the invention.

FIELD OF THE INVENTION

The present invention is in the field of insulated windows frames.

BACKGROUND OF THE INVENTION

Currently commercial windows and other fenestration systems mostly employ Aluminum framing because of the Aluminum Alloy's relatively low cost, high strength, easy manufacturability and long service life. However, Aluminum has one serious inherent disadvantage, which is high thermal conductivity. Traditionally, Aluminum framing has been plagued by poor thermal performance and low condensation resistance. There were some attempts to introduce pultruded fiberglass as a framing material for commercial framing, but these were abandoned due to very high cost and issues with manufacturing and durability. Steel reinforced PVC is also sometimes used, but this introduces thermal bridges, which largely defeat the benefits of the lower thermal conductivity of PVC. Also, there was no successful implementation of reinforced PVC in curtain walls and window walls, which represent large majority of commercial framing. Because of this, over the past couple of decades, the design of Aluminum framing has been modified to include thermal breaks of various designs. Technologies used for thermal break are generally divided into two categories: (a) Pour-and-debridge method, where the framing is extruded as a single piece with the pocket for thermal break. Liquid polyurethane is poured into the pocket and after solidifying, the backing Aluminum section is ground away. This is the older method, still in widespread use. The disadvantage of this method is that thermal break width is limited (typically it is about ¼ in.) by the structural requirements, and the thickness of the thermal break is fairly large, thus limiting the effectiveness of the thermal break. Windows incorporating this type of thermal break have generally a performance of about U=0.5 Btu/(hr·ft2·° F.), or R2. (b) Crimped strips (sometimes called I-bars), where frame is extruded into two dies and Polyamide strips (usually two) are crimped on each side to create single framing cross-section. Even though Polyamide has higher conductivity than Polyurethane, these strips have smaller cross-section (i.e., thinner) and can have larger widths than pour-and-debridge systems (normally around ½ in.), which allows for better frame performance (typically U=0.35 to 0.4 Btu/(hr·ft2·° F.) or up to R3). Their disadvantage is that this thermal performance cannot be easily improved further.

Additional methods consists of partial de-bridging of the framing web, or by using steel bolts at regular intervals to fasten indoor and outdoor frame sections.

While some of these methods have improved thermal performance of Aluminum framing, their relatively poor thermal performance still remains an issue and has resulted in relaxed code compliance requirements for commercial framing, as compared to residential framing. Namely, stricter structural requirements for commercial framing have prevented the use wood and PVC framing materials in commercial buildings, which are common materials in residential framing.

SUMMARY OF THE INVENTION

The present invention provides for a window frame comprising a rigid framework cross-section comprising a truss structure. The truss structure defines or is configured with two or more cells having triangular cross-sections. In some embodiments, the truss structure defines or is configured with at least two, three, four, five, six, seven, eight, nine, or ten cells having triangular cross-sections.

In some embodiments (see FIG. 4), the rigid framework comprising a first compartment (405 or 455) comprising the truss structure including the inner web structure (410 or 460), and optionally a second compartment (415 or 465) between the first compartment (405 or 455) and a part of the frame connecting to a window pane, and optionally a third compartment (420 or 470) between the first compartment (405 or 455) and a part of the frame connecting to a building or wall. In some embodiments, the first compartment (405 or 455), second compartment (415 or 465), and/or third compartment (420 or 470) are sealed, such as sealed from the outside of the window frame. In some embodiments, the second compartment 465 and/or third compartment 470 further comprise one or more sealed cells and/or flaps (475 and 480).

In some embodiments, the framework and/or the truss structure are of a suitable material, such as wood, plastic, aluminum, thermoplastic resin, or thermoset resin. In some embodiments, the suitable material is a poor conductor of heat. In some embodiments, the suitable material has sufficient plasticity in manufacture to form the structure of the rigid framework, including the truss structure. In some embodiments, the suitable material is a suitable polymer, such as a polyurethane. In some embodiments, the plastic, thermoplastic resin, or thermoset resin can be fabricated by extrusion, reaction injection molding (RIM), or reinforced reaction injection molding (RRIM). Further suitable materials are taught herein.

In some embodiments, the window frame has a U-factor equal to or less than 0.4 Btu/(hr·ft$^{2}$·° F.), 0.35 Btu/(hr·ft$^{2}$·° F.), 0.3 Btu/(hr—ft$^{2}$·° F.), 0.25 Btu/(hr—ft$^{2}$·° F.), 0.2 Btu/(hr—ft$^{2}$·° F.), or 0.15 Btu/(hr·ft$^{2}$·° F.).

The present invention provides for a window frame comprising a structure described or shown in FIG. 1, FIG. 2, FIG. 3, or FIG. 4 herein.

BRIEF DESCRIPTION OF THE DRAWINGS

The foregoing aspects and others will be readily appreciated by the skilled artisan from the following description of illustrative embodiments when read in conjunction with the accompanying drawings.

DETAILED DESCRIPTION OF THE INVENTION

Figure 1:
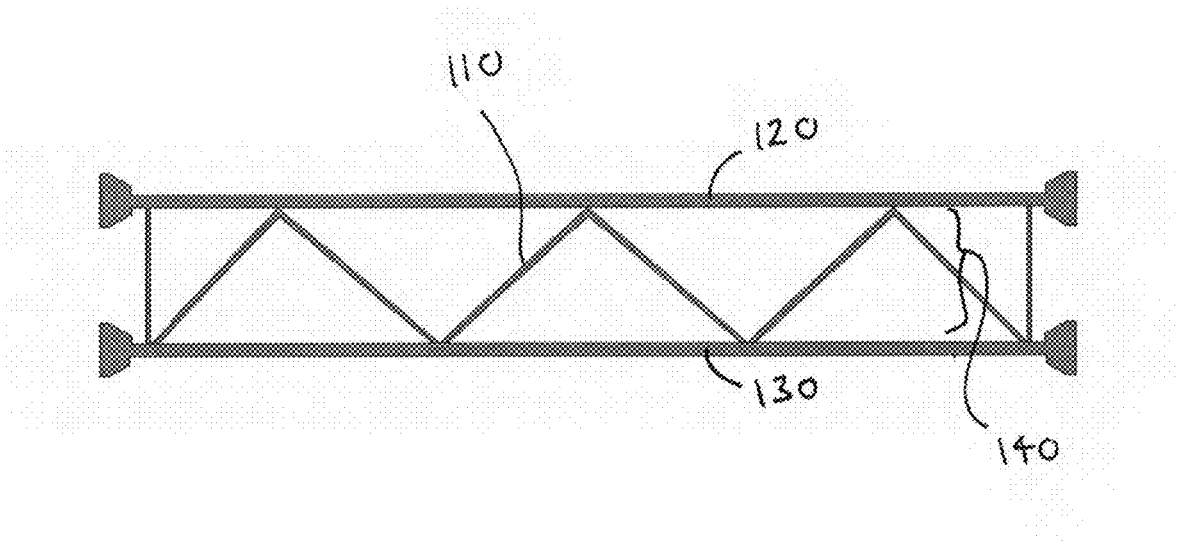
FIG. 1 shows a thermal break design utilizing truss-like structure.

Before the present invention is described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

As used in the specification and the appended claims, the singular forms "a", "an", and "the" include plural references unless the context clearly dictates otherwise. Thus, for example, reference to a "truss" includes a single truss as well as a plurality of trusses.

The terms "optional" or "optionally" as used herein mean that the subsequently described feature or structure may or may not be present, or that the subsequently described event or circumstance may or may not occur, and that the description includes instances where a particular feature or structure is present and instances where the feature or structure is absent, or instances where the event or circumstance occurs and instances where it does not.

These and other objects, advantages, and features of the invention will become apparent to those persons skilled in the art upon reading the details of the invention as more fully described below.

The objective of this project is to develop new thermal break technology that would allow Aluminum framing to have thermal performance that is comparable or better than wood or PVC, while preserving inherent benefits of Aluminum alloy material. Latest advances in polymer technology and the use of bio-based materials for the production of polymers allows for the substantial increase of thermal break while providing sustainable material that does not involve the use of fossil fuels and is more easily recyclable.

The weakness of the current thermal break system in Aluminum Alloy frames is relatively short thermal break path, which results in only incremental improvement in thermal performance. Poured polyurethane is limited to about ½ of thermal separation, while crimped strip systems are limited to about 1 in. or thermal separation, without degrading structural properties of the framing. In conjunction with the thermal conductivity of the polyurethane, which is used for poured systems and Nylon, which is used for strip systems, this separation is not enough to substantially improve thermal performance of framing systems.

This project seeks to radically modify framing design, where Aluminum material is placed on the outdoor and indoor side, as a skin, and provides anchor material for fastening frames together, thus preserving simplicity and durability, while inside of the frame is connected with the wide thermal break web. In order to provide structural integrity of such solution, thermal break will be designed as a grid of interconnected walls, in a truss-like layout, which accomplishes two important things: (a) High strength, and (b) Breakdown of convection in frame cavities.

By using truss-like structure, thickness of the polymer walls can be reduced and thermal break system can have practically unlimited lengths, thus allowing for the application of thermal break throughout the entire width of the frame. The high strength is accomplished by the use of truss-like structure and by tweaking the composition of the material, which needs to have correct amount of plasticity to be properly crimped, while maintaining overall strength of the structure.

Figure 2:
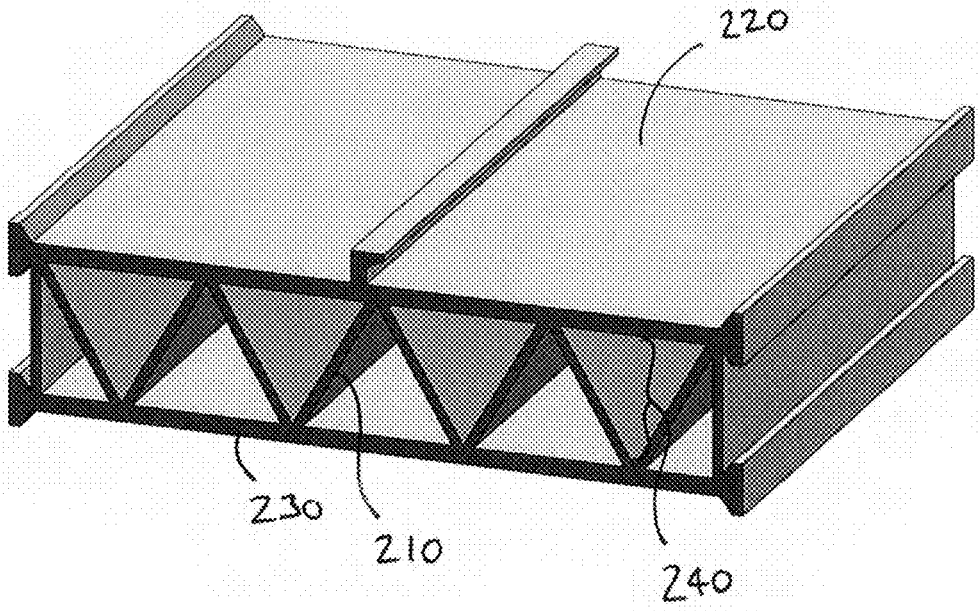
FIG. 2 shows a 3-D representation of the truss-like structure thermal break design.
Figure 3:
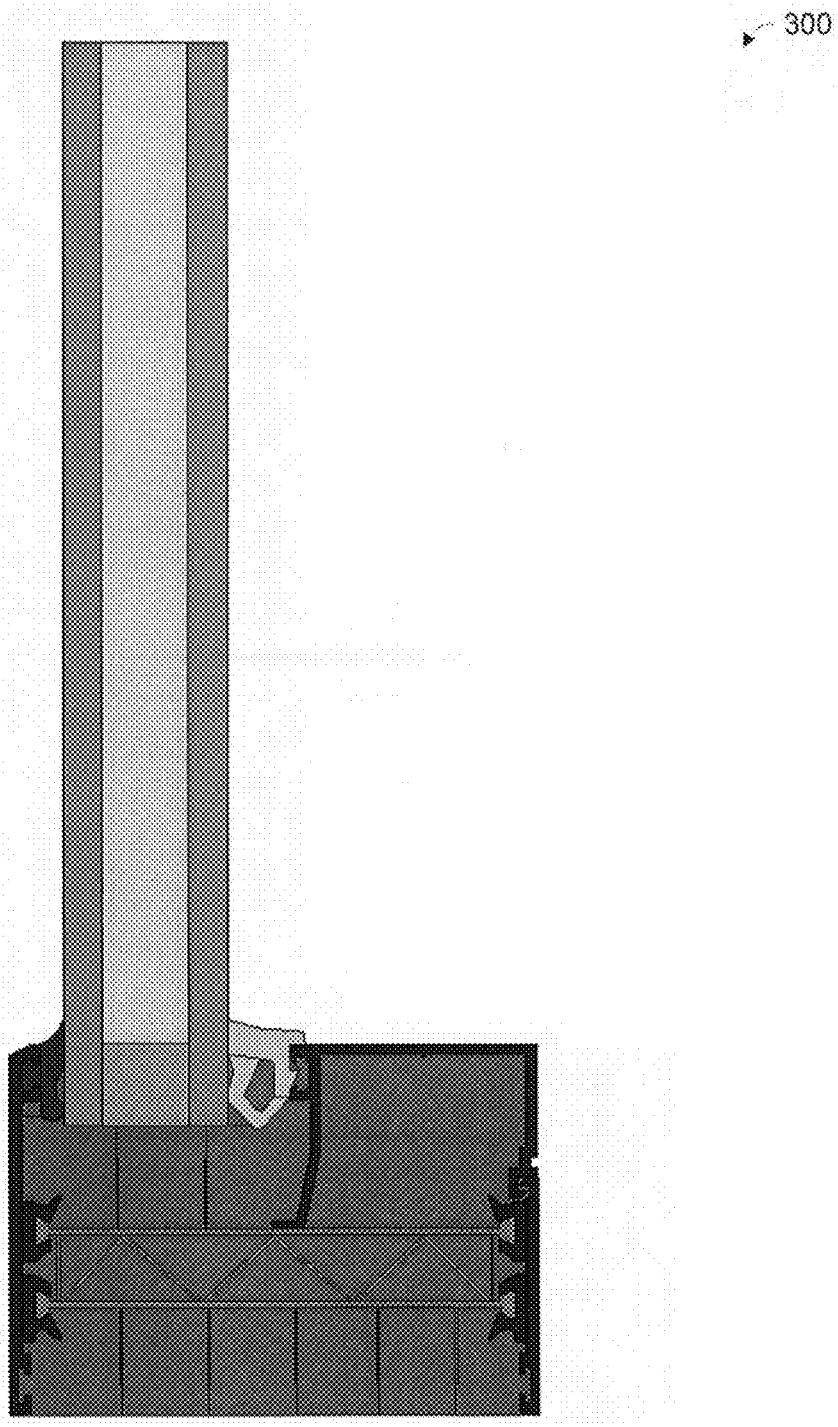
FIG. 3 shows a thermally broken aluminum frame (300) with a truss thermal break.
Figure 4:
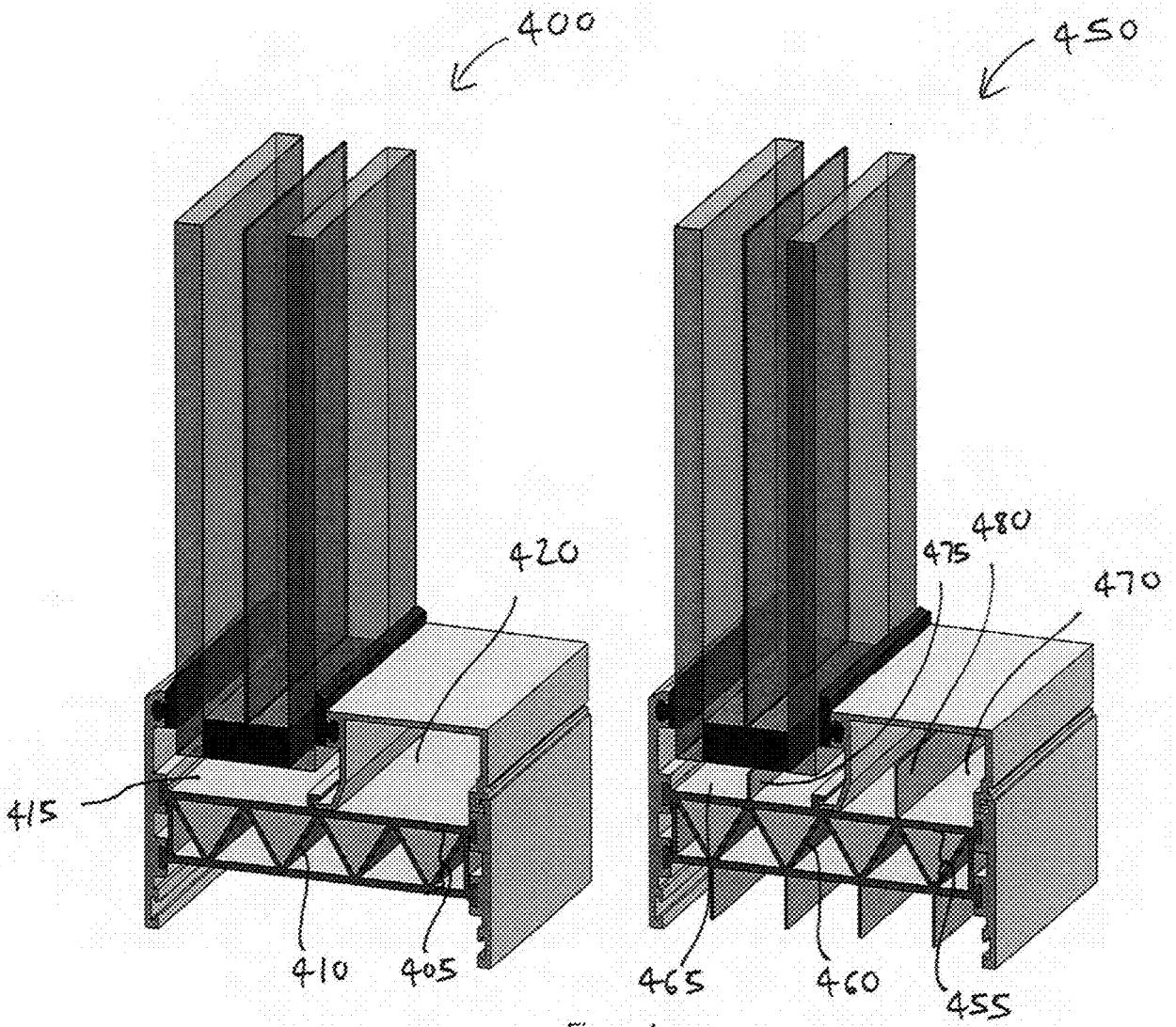
FIG. 4 shows 3D representations of the framing systems (400 and 450) with a thermal break.

Truss-like structures shown in FIGS. 1 and 2 exhibit thinner walls, as compared with traditional thermal breaks and have lengths that can span entire width of the framing system. In some embodiments, the framework spans the width of the window frame. Inner web structures (110 and 210) accomplish one additional benefit, which is to reduce convection heat transfer by breaking the space in-between two horizontal bars (120 and 130 and 220 and 230) into smaller cells. Because convection heat transfer is dependent on the size of the enclosed cavity (140 and 240) and it increases disproportionately as the size increases, by keeping cells small enough convection heat transfer can be suppressed or completely eliminated. In the example shown in FIG. 1, convection heat transfer is only 10% higher than pure conduction of air, while if the space was not subdivided into triangular cells, the convection heat transfer is almost twice the conduction of air.

Using conventional thermal break technology, typical commercial framing system can accomplish frame U-factor anywhere between 0.65 Btu/(hr—$ft^2$·° F.) to 0.8 Btu/(hr·$ft^2$·° F.). In comparison, Aluminum framing without thermal break would have U-factor of 1.5 Btu/(hr·$ft^2$·° F.). While it can seem as a substantial improvement to reduce no-thermally broken Aluminum frame by a 100%, the performance of thermally broken frames is still subpar.

When the new truss thermal break is employed, the same framing system improves its thermal performance by a staggering 300% over the performance of crimped strip thermally broken frame, over 400% from the poured polyurethane thermally broken frame and over 700% over the non-thermally broken Aluminum frame. The resulting U-factor becomes 0.2 Btu/(hr·$ft^2$·° F.). As a matter of fact, this U-factor is about 50% better than PVC frame U-factor (0.3 Btu/(hr·$ft^2$·° F.)) and about 100% better than typical wood frame U-factor (0.4 Btu/(hr·$ft^2$·° F.)). The framing system with the truss thermal break design is shown in.

Additional improvement in the performance of this frame is accomplished by placing "flaps" strategically on the exterior surfaces of the truss thermal break (vertical pieces on either side of the exterior surfaces of the thermal break).

These flaps can be made of the same material as the thermal break and can be part of the same extrusion process that creates truss thermal break, and thus would introduce negligible cost increase, because there is no structural requirements for these flaps, so they can be very thin. The purpose of flaps is to break down convection heat transfer in larger frame cavities. Their distribution and number would be subject of optimization and further improvements in thermal performance can be expected after they are optimized.

Processes and Materials for Truss-Like Structure Fabrication

The truss-like structure can be fabricated from thermoplastic and thermoset resins. They can be processed by: (a) Extrusion, (b) Reaction Injection Molding (RIM), or (c) Reinforced Reaction Injection Molding (RRIM) of polyurethanes.

Extrusion is a process used to create objects of a fixed cross-sectional profile. A material is pushed or drawn through a die of the desired cross-section. The process can be continuous (theoretically producing indefinitely long material) or semi-continuous (producing many pieces). Potential bio-based plastics that can be utilized are polylactic acid, starch and cellulose based plastics and bio-based polyesters.

Reaction injection molding (RIM) is a fabrication technique involving the extremely rapid impingement mixing of two chemically reactive liquid streams, injected into a mold that results in the simultaneous polymerization, cross-linking and formation of the part. When short fibers are incorporated into one of the reaction streams to increase modulus and reduce coefficient of expansion, the process is referred to as reinforced reaction injection molding (RRIM). The process uses thermoset polymers (commonly polyurethane) instead of thermoplastic polymers used in standard injection molding. The bi-component fluid is of much lower viscosity than molten thermoplastic polymer which allows the economical production of large parts with complex geometry. The products are strong, tough, lightweight, and can be fabricated in quick cycle times. The production of the truss-like structure can be carried out in molds designed for specific application or as larger parts that can be tailored according to the frame design.

The bio-based polyurethane based on vegetable oils or glycerin is a material of choice for the RIM or RRIM processing. It can be solid cast resin with different fillers and fibrous reinforcement or micro-cellular material with lower density. The product will have high strength, toughness and modulus, but required level of flexibility that can be easily mounted into the window frame. The reinforcing fibers used in RRIM can be of natural base such as jute, kenaf, hemp, sisal, etc.

Performance

In some embodiments, the window frame is capable of achieving R5 or better thermal performance of commercial fenestration systems. With the use advanced glazing systems, windows incorporating this thermal break system can achieve R10 thermal performance. In addition to thermal performance, this thermal break provides superior structural performance, meeting or exceeding the strictest code requirements (i.e., HC and AC rating).

Energy, Environmental and Economic Benefits

Energy Savings

In some embodiments, the window frame has a performance improvement over current commercial framing systems, and has a 300% to 400% improvement in thermal resistance compared to framing systems using the technology typically used today. This kind of thermal performance easily allows for the production of R5 or better whole fenestration product performance. Because current market has roughly 75% of pour-and-debridge thermal breaks and 25% of crimped strip thermal breaks, it can be concluded that average improvement in thermal performance for the framing alone will be 375%.

In the United States, the inventory of installed aluminum window units represents over 80% of all commercial and about 20% of all residential windows installed. The energy savings potential from using the present invention to replace the currently available thermally-broken aluminum framing system is predicted as follows:

Using present building stock, the current commercial and residential building stock consumes 2.46 quads and 6.62 quads of energy from heating, and 2.04 quads and 2.29 quads of energy from cooling, respectively. Of this, net energy flow through windows accounts for 0.411 quads for heating and 0.80 quads for cooling for commercial buildings, and 1.51 quads for heating and 0.81 quads for cooling for residential buildings. Since solar radiation is largely dependent on the choice of glazing systems, better choice of energy flow is for conduction only. Net energy flow by conduction through windows accounts for 1.04 quads for heating and −0.18 quads for cooling for commercial buildings, and 2.22 quads for heating and 0.02 quads for cooling for residential buildings. For the new building stock, ten years of post-2000 construction net energy flow by conduction through windows accounts for 0.07 quads for heating and −0.02 quads for cooling for commercial buildings, and 0.15 quads for heating and 0.01 quads for cooling for residential buildings.

Assuming that framing represents about 20% of the window area, the potential for savings using an average improvement of 375% for framing will result in overall improvement of 75% for the whole window. Using conservative estimate of 10% of aluminum market penetration of the proposed technology for the existing systems:

Existing Commercial Fenestration:

75% energy savings from conduction*(1.04-0.18)*0.1*0.8=0.052 quads

New Commercial Fenestration:

Assuming 70% penetration of the new thermal break:

| | |
|---|---|
| 75% energy savings from conduction * (0.075 − 0.02) * 0.7 * 0.8 = | 0.023 quads |
| TOTAL Commercial | 0.075 quads |

Existing Residential Fenestration:

75% energy say from conduction*(2.22+0.02)*0.1*0.2=0.034 quads

New Residential Fenestration:

Assuming. 70% penetration of the new thermal break:

| | |
|---|---|
| 75% energy savings from conduction * (0.15 + 0.01) * 0.7 = | 0.017 quads |
| TOTAL Residential | 0.051 quads |
| TOTAL Residential & Commercial: | 0.126 quads |

Assuming the generic carbon emission factor for residential and commercial space heating of 15.35 and 15.19 Kg/MMBtu respectively and that cooling is all operated by electricity with a carbon emission factor of 16.02 Kg/MMBtu, this amount of energy savings would translate into 1.91 million metric tons of carbon.

It is to be understood that, while the invention has been described in conjunction with the preferred specific embodiments thereof, the foregoing description is intended to illustrate and not limit the scope of the invention. Other aspects, advantages, and modifications within the scope of the invention will be apparent to those skilled in the art to which the invention pertains.

All patents, patent applications, and publications mentioned herein are hereby incorporated by reference in their entireties.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

What is claimed is:

1. A window frame comprising:

a first compartment defined by two walls, an inner web structure being disposed between the two walls and defining two or more cells having triangular cross-sections, the two walls and the inner web structure comprising a thermoplastic resin or a thermoset resin;

a second compartment being disposed between the first compartment and a first part of the window frame configured to connect to a window pane;

a first flap wall extending into the second compartment, the first flap wall perpendicular to one wall of the two walls and attached to a first wall of the two walls, the first flap wall comprising the thermoplastic resin or the thermoset resin;

a third compartment being disposed between the first compartment and a second part of the window frame configured to connect to a building structure; and a second flap wall extending into the third compartment, the second flap wall perpendicular to the one wall of the two walls and attached to the first wall of the two walls, the second flap wall comprising the thermoplastic resin or the thermoset resin, the window frame having a U-factor equal to or less than 0.2 Btu/(hr·ft$^{2}$·° F.).

2. The window frame of claim 1, wherein the inner web structure disposed between the two walls defines three, four, five, six, seven, eight, nine, or ten cells having triangular cross-sections.

3. The window frame of claim 1, wherein the first compartment, the second compartment, and the third compartment are sealed.

4. The window frame of claim 1, wherein the two walls, the inner web structure, the first flap wall, and the second flap wall comprise polyurethane.

5. A window frame comprising:

a first compartment defined by two walls, an inner web structure being disposed between the two walls and defining two or more cells having triangular cross-sections, the two walls and the inner web structure comprising a thermoplastic resin or a thermoset resin;

a second compartment being disposed between the first compartment and a first part of the window frame configured to connect to a window pane;

a first flap wall extending into the second compartment, the first flap wall perpendicular to one wall of the two walls and attached to a first wall of the two walls;

a third compartment being disposed between the first compartment and a second part of the window frame configured to connect to a building structure; and a second flap wall extending into the third compartment, the second flap wall perpendicular to the one wall of the two walls and attached to the first wall of the two walls.

6. The window frame of claim 5, wherein the inner web structure disposed between the two walls defines three, four, five, six, seven, eight, nine, or ten cells having triangular cross-sections.

7. The window frame of claim 5, wherein the first compartment, the second compartment, and the third compartment are sealed.

8. The window frame of claim 5, wherein the first flap wall and the second flap wall comprise the thermoplastic resin or the thermoset resin.

9. The window frame of claim 5, wherein the two walls, the inner web structure, the first flap wall, and the second flap wall comprise polyurethane.

10. The window frame of claim 5, wherein the window frame has a U-factor equal to or less than 0.2 Btu/(hr·ft$^{2}$·° F.).

* * * * *